United States Patent [19]

Maki et al.

[11] Patent Number: 4,939,829

[45] Date of Patent: Jul. 10, 1990

[54] METHOD OF AND APPARATUS FOR MANUFACTURING A GEAR

[75] Inventors: Toshio Maki; Chiyoshi Miura; Michitoshi Kono, all of Sayama, Japan

[73] Assignee: Honda Giken Kogyo Kabushiki Kaisha, Tokyo, Japan

[21] Appl. No.: 218,248

[22] Filed: Jul. 13, 1988

[30] Foreign Application Priority Data

| | | | |
|---|---|---|---|
| Jul. 13, 1987 | [JP] | Japan | 62-175416 |
| Sep. 9, 1987 | [JP] | Japan | 62-225744 |
| Sep. 9, 1987 | [JP] | Japan | 62-225745 |
| Sep. 9, 1987 | [JP] | Japan | 62-137878[U] |
| Sep. 9, 1987 | [JP] | Japan | 62-137879[U] |
| Nov. 9, 1987 | [JP] | Japan | 62-281142 |
| Nov. 9, 1987 | [JP] | Japan | 62-170108[U] |
| Nov. 25, 1987 | [JP] | Japan | 62-295386 |
| Dec. 23, 1987 | [JP] | Japan | 62-323879 |

[51] Int. Cl.[5] ..... B21D 53/28

[52] U.S. Cl. ..... 29/159.2; 72/356, 72/893.34

[58] Field of Search ..... 29/159.2, 557; 72/356, 72/359

[56] References Cited

U.S. PATENT DOCUMENTS

| | | | |
|---|---|---|---|
| 4,797,986 | 1/1989 | Yokoyama | 29/159.2 |
| 4,798,077 | 1/1989 | Douglas | 29/159.2 X |

*Primary Examiner*—Timothy V. Eley

[57] ABSTRACT

A gear is manufactured by heating a blank up to a warm working temperature range, upsetting and piercing the blank through warm forging, forming gear teeth on the blank through warm extrusion to produce an intermediate blank which is substantially of a gear shape, and then finishing the gear teeth accurately through cold sizing. The gear can be manufactured highly accurately with a good yield without requiring other intermediate processes such as normalizing and shot blasting.

20 Claims, 18 Drawing Sheets

METHOD OF AND APPARATUS FOR MANUFACTURING A GEAR

SUMMARY OF THE INVENTION

The present invention relates to a method of and an apparatus for manufacturing a gear, and more particularly to a method of and an apparatus for manufacturing a gear of a relatively complex configuration in a forging process by upsetting and piercing a blank through warm forging, forming gear teeth on the blank through warm extrusion, and then finishing the gear teeth accurately through cold sizing, whereby the manufacturing process is simplified for manufacturing high-precision gears with a good yield.

Hot forging has heretofore been relied upon to manufacture gears of complex shape and small gear thickness such as gears in automatic transmissions for use automobiles. According to the hot forging process, a round rod is formed substantially into a gear shape, which is then cut on a machine tool into an intermediate gear blank having gear teeth. Thereafter, the gear teeth are sized to a desired gear shape.

On example of a gear which is manufactured b y such hot forging is illustrated in FIG. 1, of accompanying drawings. The illustrated gear, generally denote at 2, comprises a larger-diameter portion 4 and a smaller-diameter portion 6, the larger-diameter portion 4, having gear teeth 8. The larder-diameter portion 4 has a hole 10 of a relatively large-diameter defined in a axial end face thereof. The larger-diameter portion 4 is thus of a small thickness at the axial end face thereof. The gear 2 has a plurality of holes 12*a*, 12*b*, 12*c* defined axially through the larger- and smaller-diameter portions 4, 6 and communicating with the hole 10, the holes 12*a*, 12*b*, 12*c* being of successively smaller diameters.

Since a part produced by the hot forging process is relatively simple in shape, the hot forging process itself is of good productivity. However, the forged gear 2 has quite a large region to be cut off in a subsequent machining process, and the yield of the entire production process for such gears is low. There has been a demand, therefore, for a method of manufacturing a gear by forging with increased accuracy and forming gear teeth during the forging process while dispensing with a tooth cutting process which would otherwise be effected by a machine tool.

If the gear teeth 8 are to be formed by upsetting so as to produce the gear 2 in one hot forging process, a considerable load must be imposed on the blank in order to fabricate the gear teeth 8 of a complex shape. However, the dies used for upsetting the blank may be damaged or otherwise broken by the applied load. If the gear teeth are to be formed by hot extrusion, the dies used are heated to a high temperature, and become less durable.

In the hot forging process, the blank for the gear 2 is heated up to a temperature higher than the recrystallization temperature, increasing the crystal grain size. Thus, the forged gear has to be normalized. In the hot forging process and the subsequent normalizing process, an oxide film is formed on the surface of the gear 2, and should later be removed by a shot blasting process in which the surface of the gear 2 is treated with the impact of iron balls. Accordingly, the gear 2 must be produced by many processes including the normalizing process and the shot blasting process. The surface of the gear 2 which has been treated by shot blasting is considerably rough.

If the gear 2 is to be manufactured by cold forging, it is more difficult to shape the gear teeth 8 by upsetting than by hot forging. However, where the extrusion process is employed, the durability of the dies used is not impaired unlike the hot forging process, and the gear 2 and its teeth 8 can be formed with relatively high precision. Nevertheless, since the gear 2 is of small thickness as a whole and has a complex shape including a plurality of steps, considerations such as the elongation of the blank and the like should be taken into account in manufacturing the gear 2 by cold forging. More specifically, the cold forging process is the plastic working of a blank under pressure into a desired shape at normal temperature. The elongation of the blank in the cold forging process is relatively small. Consequently, if the elongation of the blank is to be taken into consideration when manufacturing a product of complex shape such as the gear 2, the overall manufacturing process must be complicated for desired control of the blank elongation. Moreover, the gear 2 manufactured by cold forging is required to be subsequently normalized as with the hot forging in order to give the gear 2 better machinability for the next machining process. Therefore, the number of manufacturing processes needed by cold forging is also increased.

Recent years have seen wide use of a warm or hot-cold forging process in which the working of a workpiece is effected in a temperature range between the temperature ranges of the hot and cold forging processes. Research has been made in an effort to employ such a warm forging process for manufacturing gears. Most gears which are suitable to be formed by the warm forging process are relatively thick and simple in shape, and the shaping of gear teeth relies upon upset forging. It has been virtually impossible to manufacture the gear 2 of a small thickness and complex shape highly with high efficiency to accurate dimensions with the conventional warm forging process.

Various proposals have been made for sizing the gear teeth of the intermediate gear blank referred to above. One example of such a sizing process is disclosed in Japanese Laid-Open Patent Publication No. 62-110831. According to the disclosed process, the intermediate blank is placed on a finishing die, and a punch is pressed toward the die against an exposed axial end surface of the blank to size the gear teeth. Since the intermediate blank is simply pressed into the die by the punch, the intermediate blank may be positionally displaced with respect to the die when initially setting the blank on the die, and may be pressed only in a localized region, caused to fall down, or subjected to thickness irregularities thus failing to achieve a desired degree of dimensional accuracy, especially if the blank has a higher center of gravity and cannot stably be positioned on the die.

When sizing the intermediate blank with the die and the punch, since no space or zone is available for relieving a locally deformed region of the intermediate blank, the sized intermediate blank may have a folded region, a burred region, or other defective region.

SUMMARY OF THE INVENTION

It is a primary object of the present invention to provide a method of and an apparatus for manufacturing a gear of a small thickness and a complex shape by heating a blank up to a warm working temperature range, upsetting and piercing the blank through warm forging, forming gear teeth on the blank through warm extrusion to produce an intermediate blank which is substantially of a gear shape, and then finishing the gear teeth accurately through cold sizing, whereby the gear can be manufactured highly accurately with a good yield without requiring other intermediate processes such as normalizing and shot blasting.

Another object of the present invention is to provide a method of manufacturing a gear, comprising the steps of: upsetting and piercing a blank heated up to a warm forging temperature range; forming gear teeth on said blank by warm extrusion; and sizing said gear teeth by cold sizing.

Still another object of the present invention is to provide a method of manufacturing a gear, wherein said blank is upset and pierced by forming a projection on one end of said blank, defining first and second recesses in the other end of said blank and said projection, and defining a through hole through said first and second holes.

Yet still another object of the present invention is to provide a method of manufacturing a gear wherein said blank is upset and pierced to form a hollow blank having an inner hollow space therein and larger- and smaller-diameter portions, and said gear teeth are formed to produce a larger-diameter tooth portion and a smaller-diameter boss portion on the blank.

A still further object of the present invention is to provide a method of manufacturing a gear, comprising the steps of: piercing a blank to produce a hollow blank with a punch and a die; and extruding said hollow blank to form gear teeth on the hollow blank, said blank having a recess defined in an end surface thereof remote from said punch, said recess having an outer maximum diameter larger than the outside diameter of said punch and being progressively smaller in diameter toward said punch, said blank having a round corner for slidably contacting dies used to pierce said blank and extrude said hollow blank, said blank being pierced by defining a hole therein coaxially with a minimums diameter portion of said recess, said hole being slightly larger in diameter than said minimum diameter portion of the recess.

Yet another object of the present invention is to provide a method of manufacturing a gear, wherein said recess is defined by a surrounding slanted surface inclined at an angle ranging from 30° to 45° to a plane transverse to the axis of said blank.

A yet further object of the present invention is to provide a method of manufacturing a stepped gear having a hollow space therein and a larger-diameter tooth portion and a smaller-diameter boss portion, said method comprising the steps of: preparing a blank having a smaller-diameter blank portion shorter than the height of the smaller-diameter boss portion, a larger-diameter blank portion integral with said smaller-diameter blank portion, and a hollow blank portion extending through said blank portions; and defining a hollow portion in said blank with first and second forming members co acting with each other, said hollow portion including a smaller-diameter portion near said first forming member and a larger-diameter portion near said second forming member, by extruding a material of said larger-diameter blank portion toward said second forming member and pressing said material into a teeth forming region around said second forming member for thereby forming gear teeth, extruding a material of said smaller-diameter blank portion toward said first forming member for thereby forming a boss portion, bringing a material of said metal into abutment against an end surface of said first forming member, and pressing said last-mentioned material into a gap defined between said end surface and an end surface of said second forming member, substantially upon completion of the extrusion process.

A yet still further object of the present invention is to provide a method of shaping a solid blank for use in manufacturing a stepped gear having a larger-diameter portion and a smaller-diameter portion, said method comprising the steps of: placing a blank between a first die member and a second die member coating with said first die member, said first die member having a first forming member including an outer peripheral stepped portion having a projecting end surface and a second forming member having an inner peripheral surface in which said first forming member is fitted and an annular end surface; causing a material of said blank to flow in a direction toward said stepped portion of the first forming member and in a radial direction along said annular end surface of the second forming member under a pressure applied by said first forming member while the blank is being resiliently supported by said second forming member through a resilient member, in response to coaction of said first and second die members; and then bringing said second forming member into engagement with said first forming member to cause said first and second forming members to jointly apply a pressure to said blank to said the blank into the solid blank having the larger- and smaller-diameter portions.

Another object of the present invention is to provide a method of manufacturing a gear, comprising the steps of: preparing an intermediate blank having rough gear teeth on an outer peripheral surface along an axis thereof and a remainder material left on one end thereof, through an extrusion process; and pressing said intermediate blank into a die having finishing teeth to size the intermediate blank by defining a first gap between said remainder material and a tapered surface on an entrance end of said finishing teeth substantially fully around the finishing teeth, defining a second gap at bottom lands between said intermediate blank and said die, and forcibly pushing an excessive material produced by sizing the intermediate blank into said first and second gaps.

Still another object of the present invention is to provide a method of manufacturing a gear by sizing a roughly extruded intermediate blank with a die and a punch, said method comprising the steps of: bringing one end of said intermediate blank into engagement with guide means for controlling a direction in which to displace said intermediate blank; imposing a corrective load to hold an end of said punch and the other end of said intermediate blank in intimate contact with each other; and pressing said intermediate blank into said die through said guide to size the intermediate blank.

Yet another object of the present invention is to provide a method of manufacturing a gear, wherein a resilient member is held in engagement with said guide means, and said die and said punch are displaced toward each other while said one end of the intermediate blank is engaging said guide means, so that the resiliency of said resilient member acts as said corrective load to hold said end of the punch and said other end of the intermediate blank in intimate contact with each other.

Yet still another object of the present invention is to provide an apparatus for manufacturing a stepped gear having a hollow space therein and a larger-diameter tooth portion and a smaller-diameter boss portion, said apparatus comprising: first and second forming members for extruding a blank having a smaller-diameter blank portion shorter than the height of the smaller-diameter boss portion, a larger-diameter blank portion integral with said smaller-diameter blank portion, and a hollow blank portion extending through said blank portions; and a teeth forming member disposed around said second forming member, said first forming member having a recess for forming said boss portion, said second forming member having a smaller-diameter projection portion projecting toward said recess and having a diameter smaller than the inside diameter of said recess, and a larger-diameter portion coaxial with said smaller-diameter projecting portion and extending away from said first forming member, said larger-diameter portion having a maximum diameter selected to be larger than the inside diameter of said recess of said first forming member, the arrangement being such that a gap is defined between the bottom surface of said recess of the first forming member and the tip end of said smaller-diameter projection portion of said second forming member substantially upon completion of extrusion of said blank.

A further object of the present invention is to provide an apparatus for manufacturing a gear, further comprising die disposed around said second forming member and having a hole defined by an inner peripheral wall surface having a teeth forming region composed of a plurality of axially extending protuberances, said second forming member being axially movably disposed in said hole of said die.

A still further object of the present invention is to provide an apparatus for manufacturing a gear, wherein said first forming member has a guide hole defined in said recess, and said smaller-diameter projecting portion of said second forming member has a guide rod slidaby fitted in said guide hole for guiding relative movement of said first and second forming members.

A yet further object of the present invention is to provide an apparatus for manufacturing a stepped gear having a hollow space therein and a larger-diameter tooth portion and a smaller-diameter boss portion, said apparatus comprising a first inner peripheral surface defining a first hole; a second inner peripheral surface defining a second hole substantially coaxial with said first hole and having a plurality of teeth forming protuberances extending axially of said second hole; and a squeezing region joining an end of said first inner peripheral surface and an end of said second inner peripheral surface, said squeezing region having an angle of depression ranging from 10° to 15° with respect to a plane passing through said end of said second inner peripheral surface, said end of said first inner peripheral surface and said squeezing region intersecting with each other near a region which is not case-hardened, said first inner peripheral surface, said second inner peripheral surface, and said squeezing region being case-hardened except for said region which is not case-hardened.

A yet still further object of the present invention is to provide an apparatus for manufacturing a gear by pressing an intermediate blank having rough gear teeth on an outer peripheral surface along an axis thereof and a remainder material left on one end thereof, prepared through an extrusion process, into a die having finishing teeth to size the intermediate blank, said apparatus comprising a tapered surface on an entrance end of said finishing teeth substantially fully around the finishing teeth, said rough teeth of the intermediate blank having an addendum circle and a deddendum circle, said finishing teeth are shaped such that the diameter of the addendum circle of the rough teeth is larger that the diameter corresponding circle of the finishing teeth and the diameter of the deddendum circle of the rough teeth is smaller than the diameter of the corresponding circle of the finishing teeth. The rough teeth have a tooth surface which can progressively be less squeezed from bottom lands toward top lands thereof.

Another object of the present invention is to provide an apparatus for manufacturing a gear by sizing a roughly extruded intermediate gear, comprising: a pump and a die which are movable toward and away from each other along a common axis, said die being supported in a floating manner so as to be displaceable axially and circumferentially; and guide means resiliently supported on said die and displaceable axially toward said punch for controlling a direction in which said intermediate blank can be displaced.

Still another object of the present invention is to provide an apparatus for manufacturing a gear, further comprising a resilient member interposed between said die and said die holder for resiliently supporting said die in a floating manner on said die holder.

Still another object of the present invention is to provide an apparatus for manufacturing a gear by sizing a roughly extruded intermediate gear, comprising: a pump and a die which are movable toward and away from each other along a common axis, said punch having automatic centering means for tilting an axis of said punch, said punch being resiliently supported axially displaceably in confronting relation to said die; and guide means resiliently supported on said die and displaceable axially toward said punch for controlling a direction in which said intermediate blank can be displaced.

Yet another object of the present invention is to provide an apparatus for manufacturing a gear, wherein said automatic centering means comprises a first partly spherical surface defined in said punch holder and curved inwardly, and a second partly spherical surface defined in said punch and curved outwardly in complementary relation to said first partly spherical surface.

Yet still another object of the present invention is to provide an apparatus for manufacturing a gear, further comprising a resilient member mounted on said punch holder and having an end projecting out of said first partly spherical surface and engaging said second partly spherical surface for resiliently supporting said punch on said punch holder.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE DRAWINGS

Figure 1:
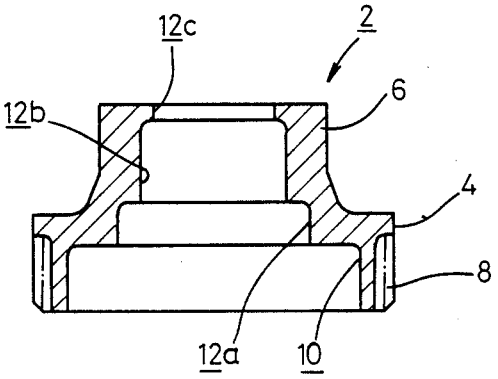
FIG. 1 is a cross-sectional view of a gear having a complex shape.

FIG. 1 shows a gear 2 to be manufactured by a method according to the present invention. Various die assemblies employed to produce the gear 2 will be described below.

Figure 2:
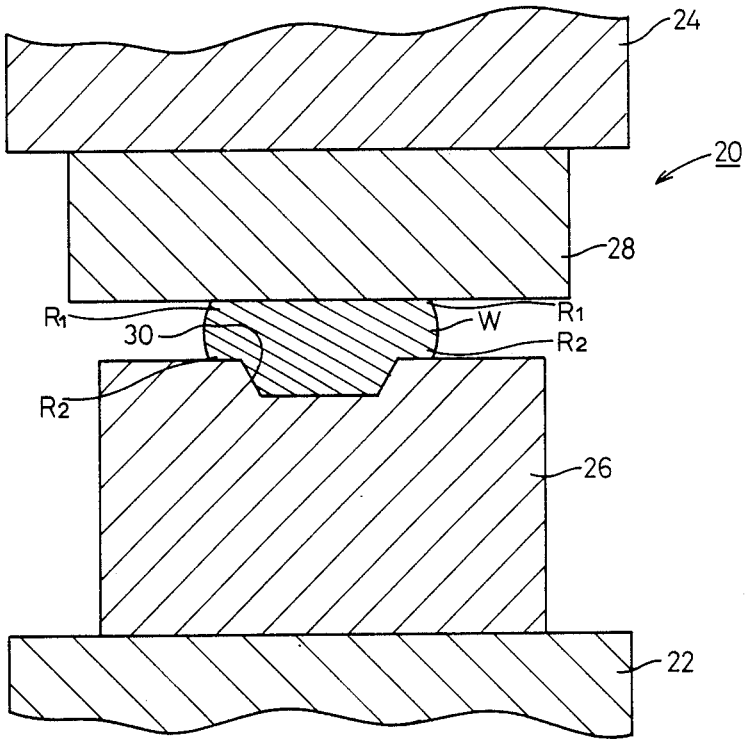
FIGS. 2 through 4 are fragmentary vertical cross-sectional views of die assemblies for upsetting, recessing, and piercing a blank, respectively, which are employed to carry out a method of the present invention.

FIG. 2 illustrates a first die assembly 20 for upsetting a blank or workpiece, the first die assembly 20 comprising a lower support 22 and an upper support 24 movable toward and away from the lower support 22. A die 26 is mounted on the upper surface of the lower support 22, whereas a punch 28 is mounted on the lower surface of the upper support 24. The die 26 has a substantially central cavity 30 defined in its upper surface, the cavity 30 being of an inverted frustoconical shape with its lower end being smaller in diameter In the first die assembly 20, a workpiece W placed on the die 26 is pressed by the punch 28 to plastically deform the lower end of the workpiece W into a projecting shape complementary to the cavity 30. The workpiece W has round corners $R_1$, $R_2$ having prescribed curvature for slidingly contacting a die which will be described later on.

Figure 3:
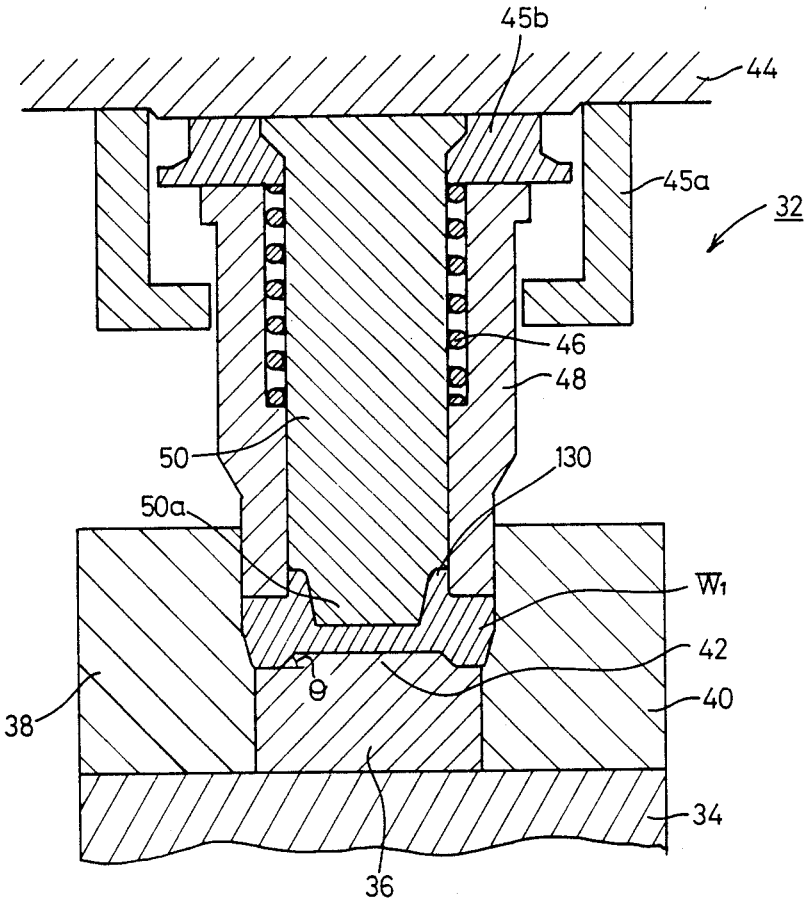

A second die assembly 32 for defining a recess in the workpiece W forged by the first die assembly 20 is illustrated in FIG. 3.

The second die assembly 32 has a substantially cylindrical die 36 mounted on the upper surface of a lower support 34 and a pair of side dies 38, 40 also mounted on the upper surface of the lower support 34 in surrounding relation to the cylindrical die 36. The die 36 has a substantially central land 42 slightly projecting upwardly and having an annular slanted edge inclined at an angle $\theta$ (preferably in the range of from 30° to 45°) to a horizontal plane. The second die assembly 32 also includes an upper support 44 movable toward and away from the lower support 34. To the lower surface of the upper support 44, there are fixed a first stopper 45*a* and a second stopper 45*b* positioned inside of the first stopper 45*a*. A substantially cylindrical punch 48 has an upper end retained in the first stopper 45*a*, the punch 48 being resiliently biased by a coil spring 46. The punch 48 has an axial inner space defined therein in which a recess forming punch 50 is slidably fitted. The recess forming punch 50 has an upper end retained in the second stopper 45*b* and a lower end including a tapered projection 50*a* projecting downwardly. The projection 50*a* serves to define a recess in the workpiece W in complementary relation.

Figure 4:
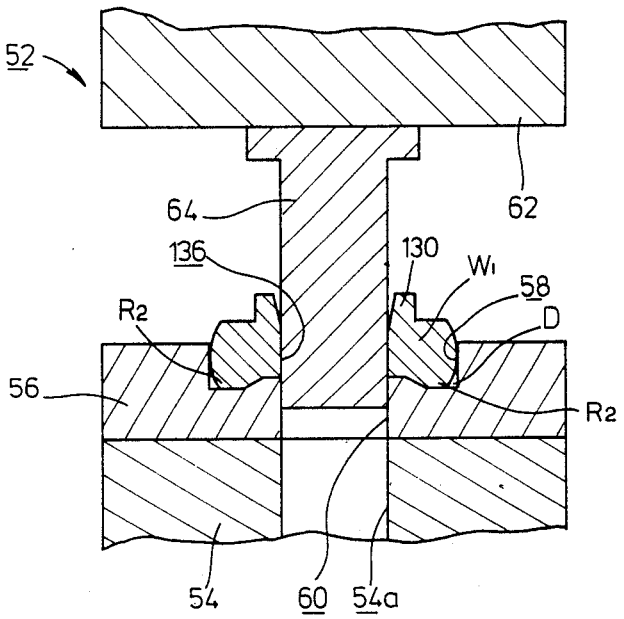

FIG. 4 illustrates a piercing die assembly 52 for piercing the workpiece W axially through the bottom of the recess which is defined in the workpiece W by the recess forming punch 50 of the second die assembly 32.

The piercing die assembly 52 includes a piercing die 56 mounted on a lower support 54 which has a substantially central hole 54*a* defined therein. The piercing die 56 has a cavity 58 defined substantially centrally in its upper surface for accommodating the workpiece W therein, and a hole 60 defined substantially centrally in the piercing die 56 through the end surface or bottom of the cavity 58. The hole 60 is held coaxially in communication with the hole 54*a* in the lower support 54.

The piercing die assembly 52 further includes an upper support 62 with a piercing punch 64 mounted on the lower surface thereof. The piercing punch 64 has a lower end insertable into the hole 60 in the piercing die 56 upon downward displacement of the upper support 62.

The workpiece W which has been pierced by the piercing die assembly 52 is shaped into a desired configuration, i.e., the gear 2, and rough teeth (described later) corresponding to the gear teeth 8 are extruded, by means of an extrusion die assembly 70 shown in FIGS. 5 and 6.

Figure 5:
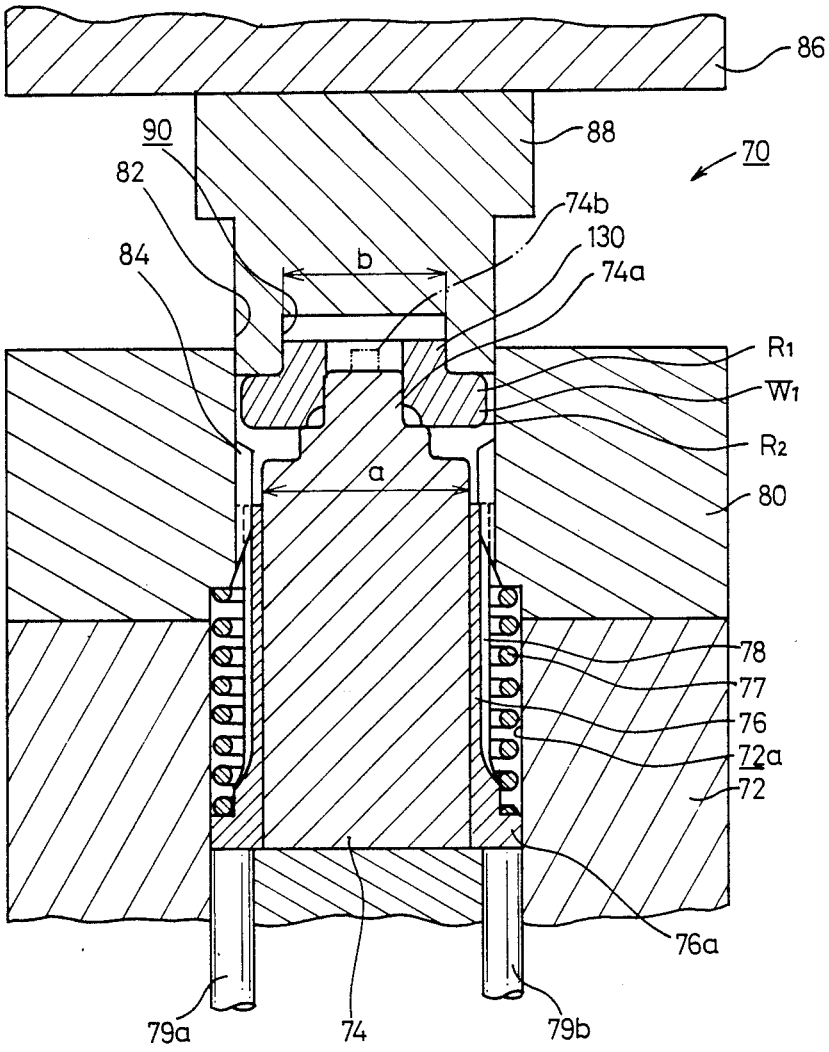
FIGS. 5 and 6 are fragmentary vertical cross-sectional views of an extrusion die assembly for carrying out the method of the invention.
Figure 6:
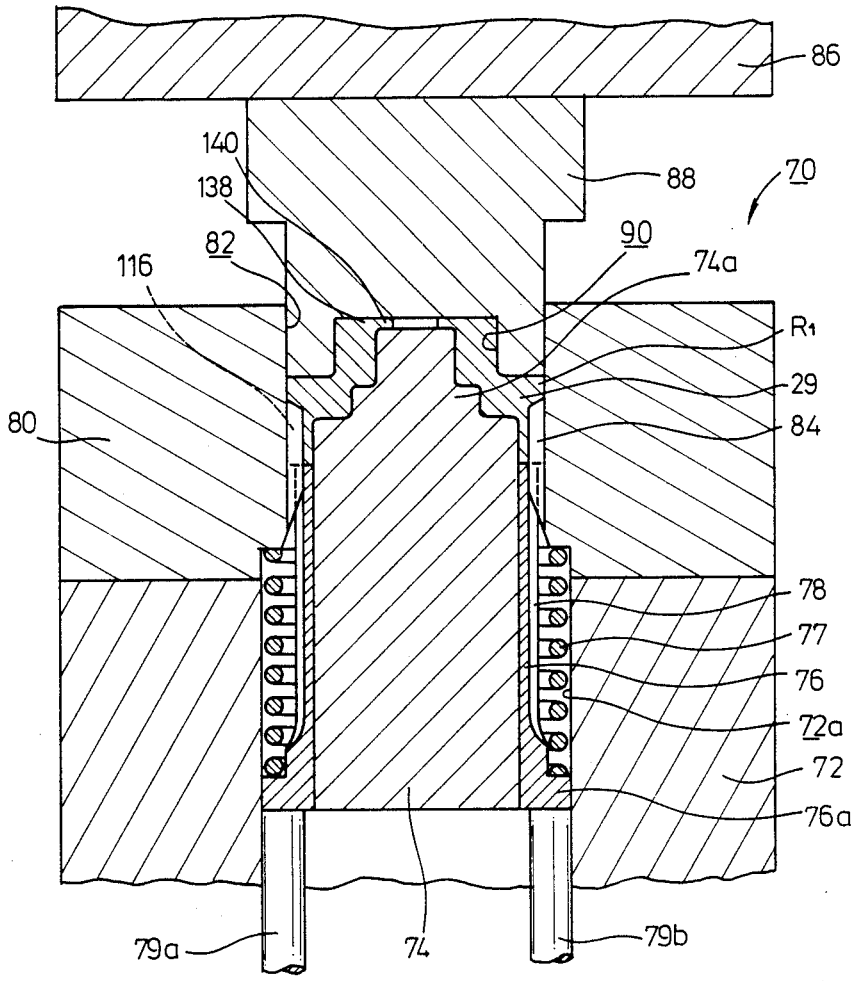

As illustrated in FIGS. 5 and 6, the extrusion die assembly 70 includes a punch 74 loosely fitted in a hole 72*a* defined in a lower support 72. The punch 74 has a stepped portion 74*a* on its upper end which has two steps that are successively smaller in diameter upwardly. A movable member 76 is slidably fitted over the punch 74 and has a substantially cylindrical shape having a flange 76*a* slidably fitted in the hole 72*a*. The movable member 76 has a plurality of ridges 78 disposed on and spaced circumferentially around the outer periphery of the movable member 76, the ridges 78 extending in the axial direction of the movable member 76.

A coil spring 77 disposed around the movable member 76 has one end held against the flange 76*a* for normally urging the movable member 76 to move downwardly. Rods 79*a*, 79*b* are held against the lower end of the movable member 76 for pushing the movable member 76 upwardly in response of operation of an actuator (not shown).

Figure 7:
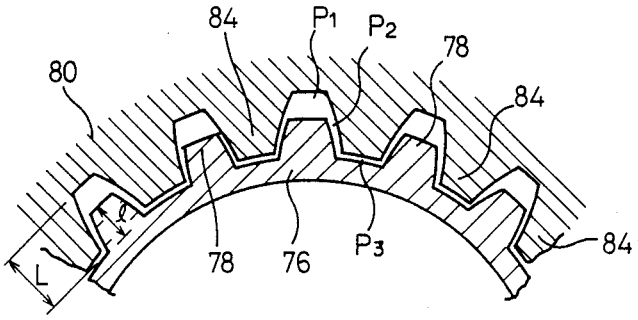
FIG. 7 is a cross-sectional view taken along line VII—VII of FIG. 6.

A teeth forming member 80 is mounted on the lower support 72 in the vicinity of the upper end of the punch 74. The teeth forming member 80 has a substantially central hole 82 defined axially therethrough by an inner peripheral surface which has a plurality of protuberances 84 spaced circumferentially and extending axially of the teeth forming member 80 for forming rough teeth corresponding to the gear teeth 8 of the gear 2. The ridges 78 of the movable member 76 engage in or overlap grooves defined between the protuberances 84 of the teeth forming member 80. As shown in FIG. 7, the ridges 78 have a whole depth l which is about ½ of the whole depth L of the protuberances 84. Lubricating fluid passages $P_1$, $P_2$, $P_3$ are defined between the ridges 78 and the protuberances 84.

The extrusion die assembly 70 also includes a die 88 mounted on an upper support 86 above the lower support 72. The die 88 has a cavity 90 defined in the lower end of the die 88. The stepped portion 74*a* of the punch 74 can be inserted into the cavity 90 when the upper support 86 is moved toward the lower support 72. The stepped portion 74*a* has a maximum diameter a greater than the inside diameter b of the cavity 90 of the die 88 (see FIG. 5). The upper support 86 and the die 88 are movable toward and away from the lower support 72.

Figure 8:
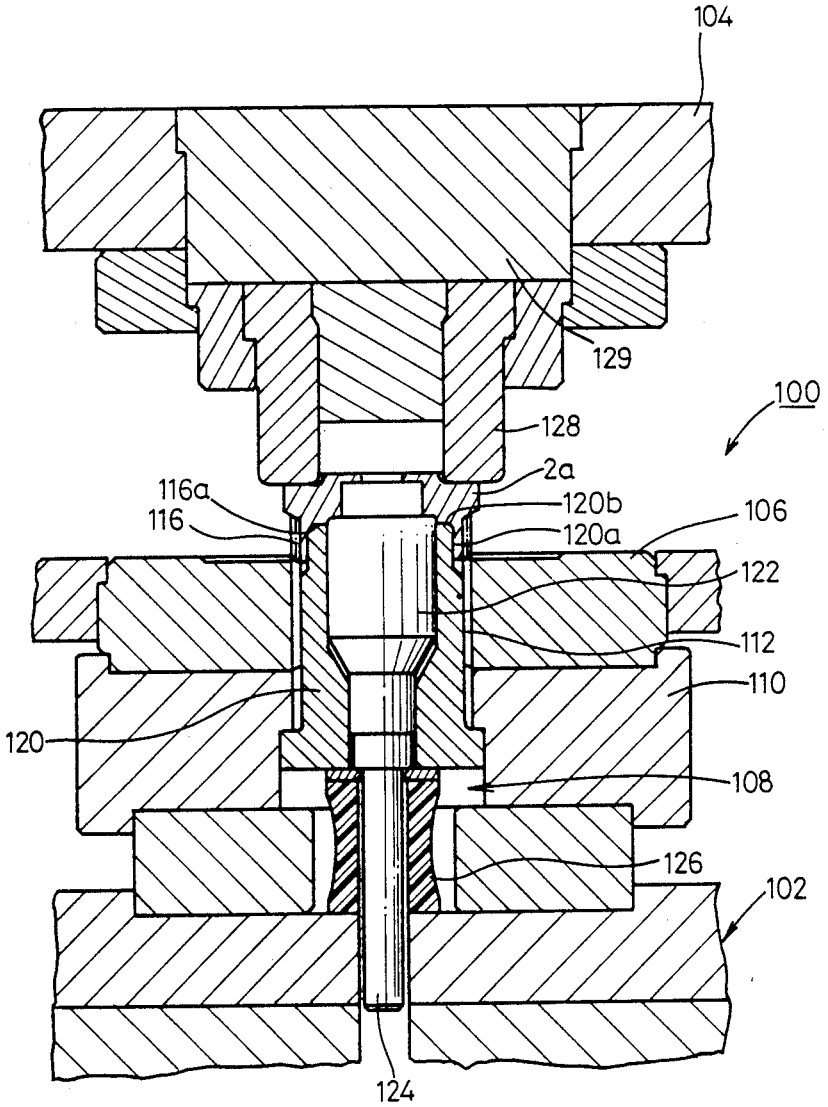
FIGS. 8 and 9 are fragmentary vertical cross-sectional views of a sizing device for carrying out the method of the present invention.
Figure 9:
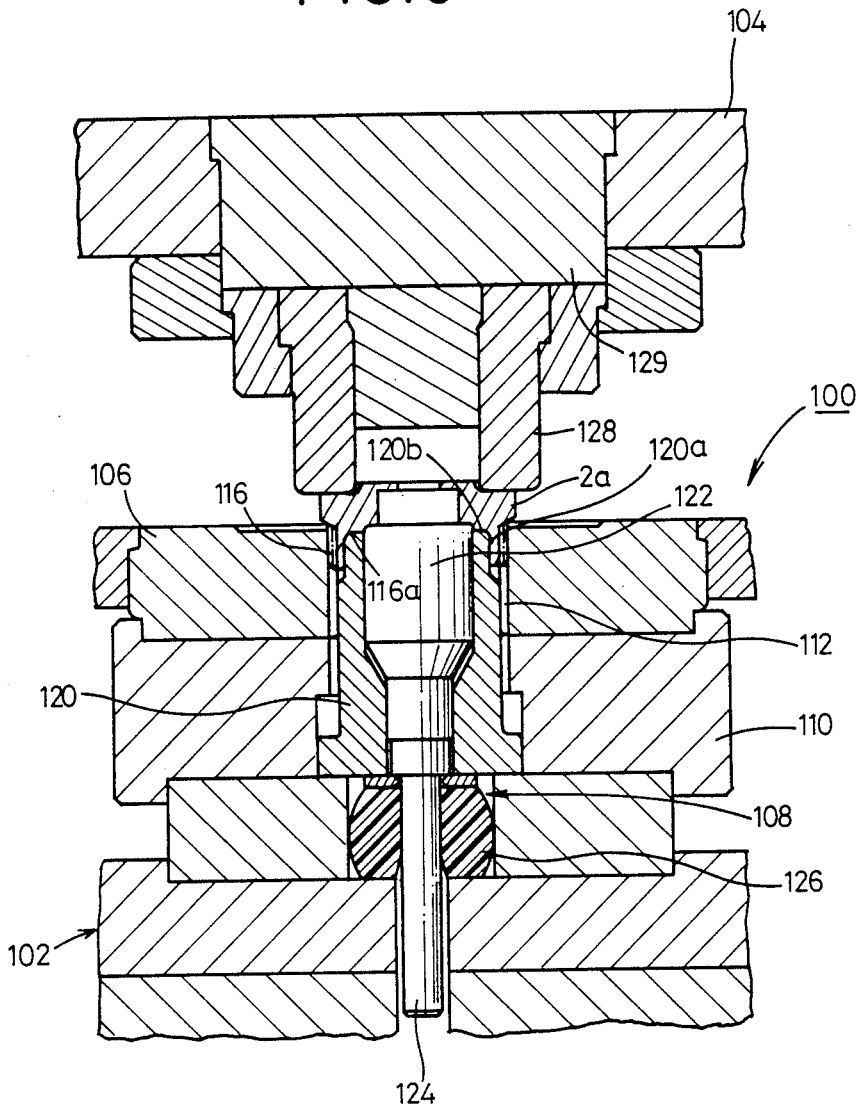

FIGS. 8 and 9 show a sizing device 100 for sizing the workpiece W, or an intermediate blank 2*a*, which has been roughly forged into the shape corresponding to the gear 2 by the extrusion die assembly 70. The sizing device 100 comprises a lower support 102 and an upper support 104 movable toward and away from the lower support 102. A die 106 and a knockout punch 108 are mounted on the lower support 102.

Figure 10:
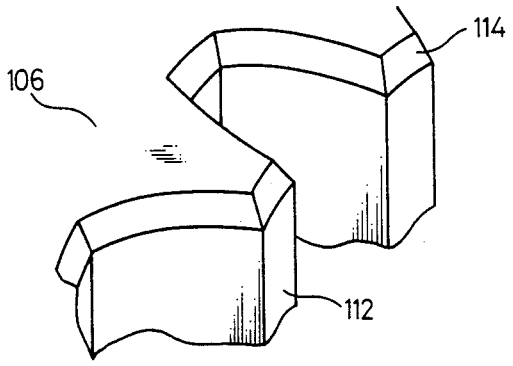
FIGS. 10 and 11 are fragmentary perspective and plan views of finishing teeth on a die of the sizing device.
Figure 11:
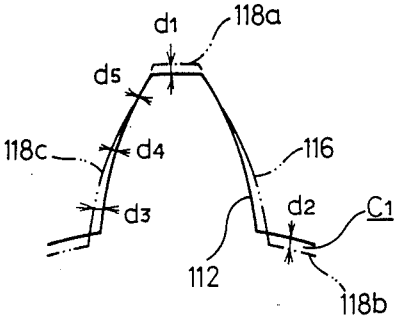

The die 106 is fixed to the lower support 102 by a die holder 110. The die 106 has a substantially central hole defined by an inner peripheral surface which has finishing teeth 112. As shown in FIG. 10, the finishing teeth 112 have a substantially uniform tapered or beveled edge 114 extending fully along the entire periphery of the teeth 112 and positioned at the entrance side of the die 106. As illustrated in FIG. 11, the intermediate blank 2*a* has rough teeth 116. The finishing teeth 112 are shaped such that the diameter of the addendum circle of the rough teeth 116 is larger, by d1, than the diameter of the corresponding circle of the finishing teeth 112, and the diameter of the deddendum circle of the rough teeth 116 is smaller, by d2, than the diameter of the corresponding circle of the finishing teeth 112. Therefore, when the intermediate blank 2*a* is sized by the sizing device 100, the top lands of the rough teeth 116 are squeezed, but the bottom lands of the rough teeth 116 are not as there is a gap $C_1$ left between the bottom lands of the rough teeth 116 and the top lands of the finishing teeth 112. Each of the rough teeth 116 of the intermediate blank 2*a* has a tooth surface 118*c* which will be progressively less squeezed outwardly from the bottom land to the top land (see d3 through d5 in FIG. 11).

Referring back to FIGS. 8 and 9, the knockout punch 108 comprises a guide member 120 axially slidably engaging the die 106 and the die holder 110, a knockout 122 axially slidably housed in the guide member 120, and a knockout pin 124 for axially moving the knockout 122. The guide member 120 has an upper end 120*a* which will be fitted in the hole 10 of the gear 1 shown in FIG. 1, and the knockout 122 has an upper end which will be fitted in the hole 12*a* of the gear 2.

A cushioning member 126 made of urethane resin or the like is interposed between the guide member 120 and the lower die 102 for normally urging the guide member 120 vertically upwardly.

On the upper support 104, there is mounted a substantially cylindrical pusher punch 128 by a punch holder 129.

The various die assemblies described above which will be used to carry out the method of the present invention operates as follows:

The lower and upper supports 22, 24 of the first die assembly 20 are spaced from each other, and a workpiece W (in the form of a cylindrical blank) which is heated to a warm working temperature range is placed on the die 26 mounted on the lower support 22. Then, the upper support 24 is lowered toward the lower support 22 to bring the punch 28 mounted on the upper support 24 again the workpiece W. The upper support 24 is further displaced downwardly to cause the punch 28 to deform the workpiece W. Since the die 26 has the cavity 30, a portion of the workpiece W enters the cavity 30, and is shaped as a bulging land on the workpiece W.

After the workpiece W has been upset by the first die assembly 20, the workpiece W is transferred onto the die 36 of the second die assembly 32 shown in FIG. 3. At this time, the workpiece W is turned over so that the surface thereof which was held against the punch 28 when upset-forged by the first die assembly 20 is held against the upper surface of the die 36 of the second die assembly 32.

Figure 12:
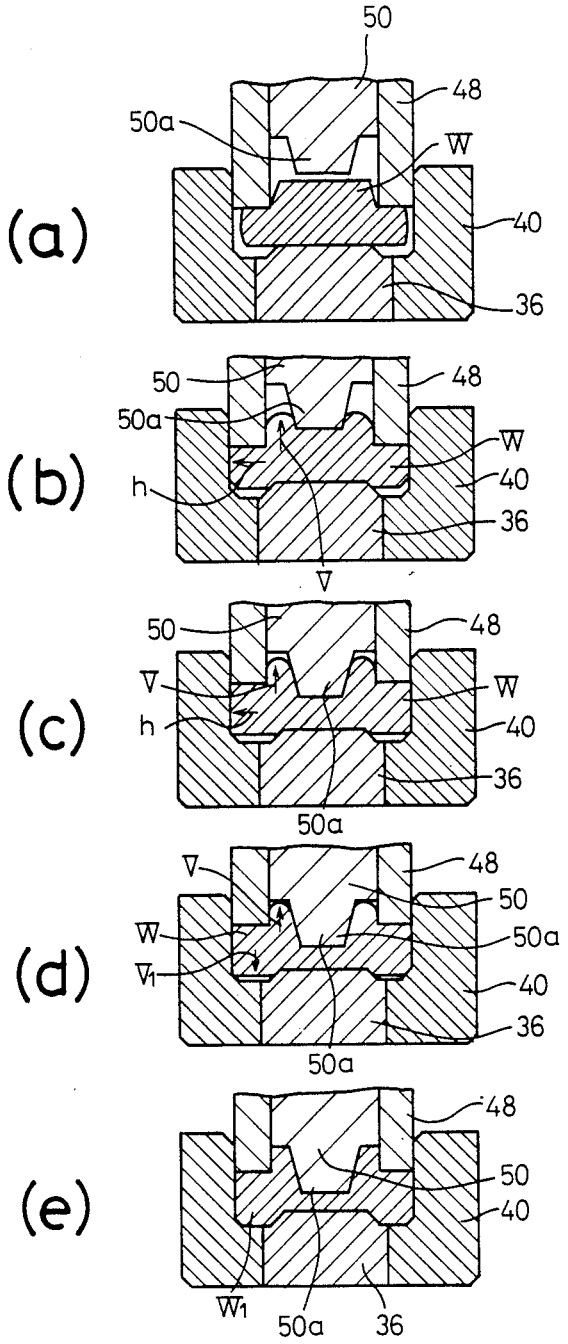
FIGS. 12(*a*) through 12(*e*) are cross-sectional views showing the manner in which a blank is forged by the recessing die assembly shown in FIG. 3.

The upper support of the second die assembly 32 is lowered to displace the punch 48 and the recess forming punch 50 downwardly. The punch 48 first presses the workpiece W as shown in FIG. 12(*a*). Since the coil spring 46 is disposed between the upper support 44 and the punch 48, when the upper support 44 is lowered, the force with which the punch 48 presses the workpiece W is increased as the resilient force of the coil spring 46 is also increased. Continued downward movement of the upper support 44 causes the lower end of the workpiece W to be deformed along the die 36, and pushes the projection 50*a* of the recess forming punch 50 into the upper end of the workpiece W. As illustrated in FIGS. 12(*b*) and 12(*c*), metal flows in the directions of the arrows V and h in the workpiece W. The metal flow in the direction of the arrow h is confined below the lower surface of the punch 48, and the workpiece W provides a flat surface which substantially coincides with the lower surface of the punch 48.

As the upper support 44 is further lowered, the punch 48 is almost entirely stopped by the resistance of the workpiece W, whereas only the recess forming punch 50 is lowered. The punch 48 then engages the second stopper 45*b*, and the punch 48 and the recess forming punch 50 are moved downwardly in unison with each other. As shown in FIG. 12(*d*), metal in the workpiece W flows in the directions of the arrows V, $V_1$ until finally a shaped workpiece $W_1$ is formed (FIG. 12(*e*)).

Because the workpiece W is forged by the recess forming punch 50 while the workpiece W is pressed down by the punch 48, metal in the workpiece W flows horizontally and vertically by being guided by the punch 48 Therefore, when the workpiece W is then forcibly pressed by the punch 48, no undue deformation is caused on the workpiece $W_1$ and the workpiece $W_1$ which is free of defects can be produced.

Figure 13:
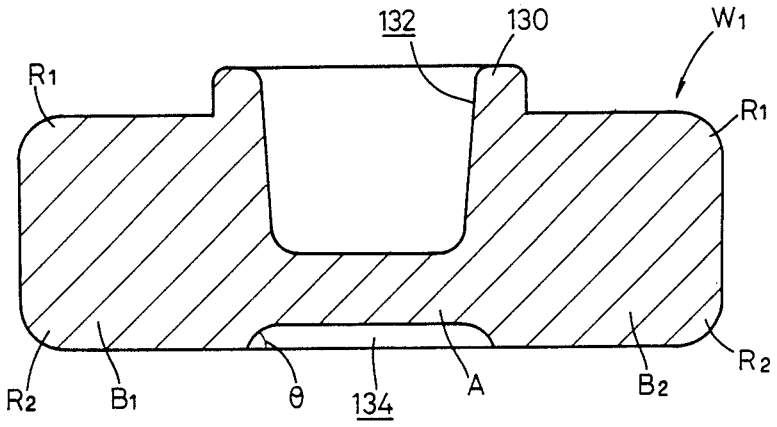
FIG. 13 is an enlarged cross-sectional view of a workpiece produced by the sequence shown in FIGS. 12(*a*) through 12(*e*)

Then, the upper support 44 is lifted away from the lower support 34, and the workpiece $W_1$ is removed from the second die assembly 32. The workpiece $W_1$ is shown at enlarged scale in FIG. 13.

The workpiece $W_1$ has an annular ridge 130 formed by and between the punch 48 and the recess forming punch 50, and a recess 132 defined inwardly of the ridge 130. The recess 132 is formed in order to reduce a load which will be imposed on the piercing punch 64 (FIG. 4) in a piercing process (described later on).

The workpiece $W_1$ also has a recess 134 defined in the end surface thereof remote from the end surface where the recess 132 is defined. The recess 134 is of a substantially frustoconical shape with its diameter progressively smaller into the workpiece $W_1$. The outer maximum diameter of the recess 134 is larger than the outside diameter of the piercing punch 64. The recess 134 is defined by a surrounding slanted surface which is inclined at an angle 8 ranging from 30° to 45° to the end surface of the workpiece $W_1$.

If the angle $\theta$ were smaller than 30°, the workpiece $W_1$ would be liable to be burred when it is pierced. If the angle $\theta$ were greater than 45°, surrounding portions $B_1$, $B_2$ would tend to be flexed inwardly when a central portion A of the workpiece $W_1$ is pressed by the piercing punch 64, so that the shape of a formed hollow blank will be impaired.

Then, the workpiece $W_1$ is placed in the cavity 58 of the piercing die 56 of the piercing die assembly 52 shown in FIG. 4. The upper support 62 is lowered to insert the piercing punch 64 mounted thereon into the recess 132 of the workpiece $W_1$. The upper support 62 is further displaced downwardly to force the piercing punch 64 through the bottom end of the recess 132 into the hole 60 of the piercing die 56, thus defining a through hole 136 in the workpiece $W_1$.

When the workpiece $W_1$ is placed on the piercing die 56 as shown in FIG. 4, there are defined gaps D between the round corners $R_2$ of the workpiece $W_1$ and the piercing die 56. Since lubricating oil is retained in the gaps D, the inner surface of the piercing die 56 is not damaged by the round corners $R_2$.

Figure 14:
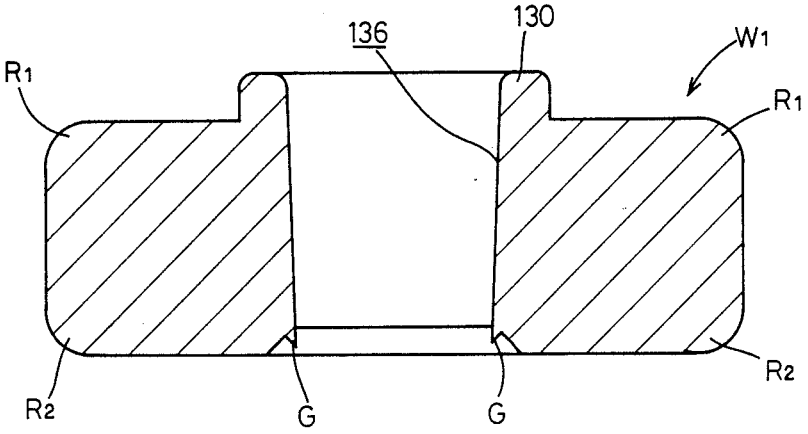
FIG. 14 is an enlarged cross-sectional view of the workpiece which is pierced by the piercing die assembly shown in FIG. 4.

The outer maximum diameter of the recess 134 of the workpiece $W_1$ is greater than the outside diameter of the piercing punch 64. Thus, when the through hole 136 is defined in the workpiece $W_1$ by the piercing punch 64, burrs G produced on the workpiece $W_1$ in the recess 136 do not project out beyond the lower surface of the workpiece $W_1$ (see FIG. 14). Therefore, the burrs G do not impair the appearance of the gear product, and can be reduced in size to the extent that they will not damage a die in a subsequent gear teeth forming process.

The workpiece $W_1$ with the through hole 136 defined therein is then positioned on the punch 74 of the extrusion die assembly 70 with the ridge 130 directed toward the die 88, and then the upper support 86 is lowered. At this time, the movable member 76 slidably fitted over the punch 74 is displaced upwardly by the rods **79*a*, 79*b* which are held against the lower end of the movable member 76 and displaced upwardly by the driver (not shown) against the resiliency of the coil spring 77**.

The upper support 86 is lowered to press the workpiece $W_1$ while the die 88 is being fitted in the hole 82 of the teeth forming member 80.

Now, there is defined a stepped hollow space in the through hole 136 of the workpiece $W_1$ by the stepped portion **74*a* of the punch 74, the stepped hollow space being complementary in shape to the stepped portion 74*a* and having a smaller diameter near the die 88 and a larger diameter near the punch 74. A larger-diameter portion of the workpiece $W_1$ is pushed over the punch 74, and as the punch 74 defines a larger-diameter hollow space in the workpiece $W_1$, metal in the larger-diameter portion of the workpiece $W_1$ is forced into the spaces or grooves between the protuberances 84 of the teeth forming member 80, thus forming rough teeth 116 (FIG. 6) corresponding to the gear teeth 8 of the gear 2 shown in FIG. 1**.

When the extrusion of the workpiece $W_1$ in the extrusion die assembly 70 progresses until the rough teeth 116 are substantially completely formed, a smaller-diameter portion of the workpiece $W_1$ (on the ridge 130) is pushed into the cavity 90 of the die 88 as the stepped hollow space is defined in the workpiece $W_1$. The workpiece $W_1$ is forced against the bottom surface of the cavity 90 whereupon a boss 138 is formed.

At this time, a clearance or gap is left between the tip end of the stepped portion **74*a* of the punch 74 and the bottom surface of the cavity 90. Therefore, when the workpiece $W_1$ is forced against the bottom surface of the cavity 90, metal of the workpiece $W_1$ flows into the clearance to form an extension 140 before the extrusion process is completed. The tip end of the stepped portion 74*a* may have a projection 74*b* of a suitable height in order to shape the extension 140**.

As described above, after a portion of the workpiece $W_1$ has been pushed into the cavity 90 by the punch 74 and held against the bottom of the cavity 90, metal of the pushed portion of the workpiece $W_1$ is forced into the clearance between the tip end of the stepped portion **74*a* and the bottom surface of the cavity 90. Therefore, the upper end surface of an intermediate blank 2*a*** thus shaped is dimensioned accurately.

Since the workpiece $W_1$ is not confined in a closed spaced until the extrusion process is finished, the load on the extrusion die assembly 70 is low, and the intermediate blank **2*a*** of small thickness and a complex shape can reliably be forged.

The workpiece $W_1$ is thus deformed into the intermediate blank **2*a* which has portions corresponding to the larger-diameter portion 4 and the smaller-diameter portion of the gear 2, holes corresponding to the holes 12*a* through 12*c* of the gear 2, and the rough teeth 116**.

After the intermediate blank **2*a* has been formed, it is removed from the extrusion die assembly 70. As shown in FIG. 7, relatively large lubricating fluid passages $P_1$ through $P_3$ are defined between the protuberances 84 of the teeth forming member 80 and the ridges 78 of the movable member 76. After the intermediate blank 2*a* has been removed, desired areas of the teeth forming member 80** can be uniformly cooled by supplying a lubricating fluid into the lubricating fluid passages $P_1$ through $P_1$.

Inasmuch as the workpiece $W_1$ has the round corners $R_1$, $R_2$, as shown in FIGS. 5 and 6, no burr and scuffing is produced on the corners of the workpiece $W_1$.

The intermediate blank **2*a* which is roughly shaped like the gear 2 is formed in the aforesaid procedure. After the intermediate blank 2*a*** is cooled, it is subjected to cold sizing.

Figure 15:
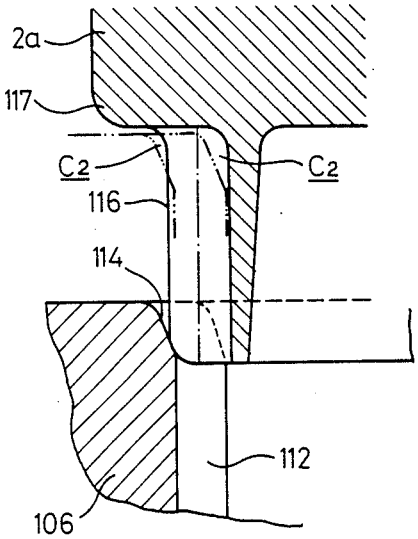
FIG. 15 is an enlarged fragmentary cross-sectional view showing sizing operation effected by the sizing device.

With the upper support 104 being spaced from the lower support 102 (FIGS. 8 and 9), the intermediate blank **2*a* is fitted over the upper end 120*a* of the guide member 120, and the rough teeth 116** of the intermediate gear 2a are brought into phase or meshing alignment with the finishing teeth 112 of the die 106. At this time, the lower ends of the rough teeth 116 and the upper ends of the die 106 may be held in engagement with each other at the tapered surface 114 as shown in FIG. 15, or slightly spaced from each other. In any case, it is preferable that the axial inner end surface 116a of the intermediate blank 2a be held in intimate contact with the upper end surface 120b of the guide member 120.

Then, the upper support 104 is lowered to bring the pusher punch 128 into abutment against the upper surface of he intermediate blank 2a. Since the intermediate blank 2a is resiliently supported axially in a floating manner by the guide member 120 supported on the cushioning member 126, the pusher punch 128 and the intermediate blank 2a are held in intimate contact with each other under the reactive forces of the cushioning member 126 before the intermediate blank 2a is pressed into the die 106. The perpendicularity of the intermediate blank 2a with respect to the axis of the die 106 is therefore corrected (FIG. 8).

By depressing the pusher punch 128 against the resiliency of the cushioning member 126, the intermediate blank 2a is guided by the uniform tapered surface 114 at the entrance end of the finishing teeth 112 to be pushed into the die 106 (FIG. 9) while the intermediate blank 2a is being sandwiched between the pusher punch 128 and the guide member 120. The rough teeth 116 of the intermediate blank 2a are prevented from being distorted because the axis of the intermediate blank 2a along which it is slid on pressed displacement is properly held, and also because the inner peripheral surface of the stepped hollow space of the intermediate blank 2a is restrained by the upper end 120a of the guide member 120.

Upon further downward movement of the upper support 104, the intermediate blank 2a is forcibly pressed into the die 106 by the pusher punch 128. Since the shape of the finishing teeth 2a is selected with respect to the shape of the rough teeth 116 as shown in FIG. 11, metal of the tooth surface 118c flows in a direction from the bottom land toward the top land, so that the surface roughness of the tooth surfaces of the gear teeth 8 after the sizing process is stabilized. The diameter of the addendum circle which is of relative importance is achieved with desired accuracy, whereas excessive metal is absorbed primarily by the bottom lands. Excessive metal pressed axially is absorbed, as a remainder pushed and left at one axial end of the intermediate blank 2a, in a gap C, (FIG. 15) defined between the flange 117 and the corners of the rough teeth 116 and the tapered surface 114.

After the intermediate blank 2a has been pressed, the upper support 104 with the pusher punch 128 is elevated, whereupon the intermediate blank 2a is removed from the die 106 under the reactive forces of the cushioning member 126. Then, the driver (not shown) is actuated to project the knockout pin 124 for thereby causing the knockout 122 to eject the intermediate blank 2a as a completed product or the gear 2 out of the guide member 120.

Conventionally, the axial movement of the intermediate blank 2a is guided solely by the inner peripheral surface of the die during the sizing process. Therefore, if the center of gravity of the intermediate blank 2a is too high, it tends to be positioned unstably with respect to the die, and if the intermediate blank 2a positioned unstably is pressed into the die, it is difficult to achieve a desired degree of dimensional accuracy.

In the illustrated embodiment, however, the above conventional problem does not occur since the axis of sliding movement of the intermediate blank 2a is properly maintained, and the parallelism of the surface of the intermediate blank 2a to the pusher punch 128 is corrected accurately prior to the sizing process.

In the aforesaid embodiment, the intermediate blank 2a and the pusher punch 128 are held in intimate contact with each other under a corrective load applied by the resiliency of the cushioning member 126. However, such a corrective load may be produced as a relief pressure or an accumulated pressure in a hydraulic pressure device. At any rate, at least the pressure needed to correct the end surface of the intermediate blank 2a should be generated at the upper limit position of the guide member 120 prior to the sizing process.

According to this embodiment, the workpiece W is forced into the gear 2 in a warm forging temperature range by upsetting, piercing, and extrusion processes. Therefore, the workpiece W is not heated to and beyond its recrystallization temperature, and hence any normalizing process is not required. Since no oxide film is formed on the workpiece W, it is not necessary to carry out a shot blasting process. Consequently, the gear 2 can be manufactured in a reduced number of manufacturing processes with a good yield, and the outer surface of the gear 2 can be finished sightly.

The teeth of the finished gear 2 are of high precision since the the teeth that have been formed by warm extrusion are subjected to cold sizing.

Figure 16:
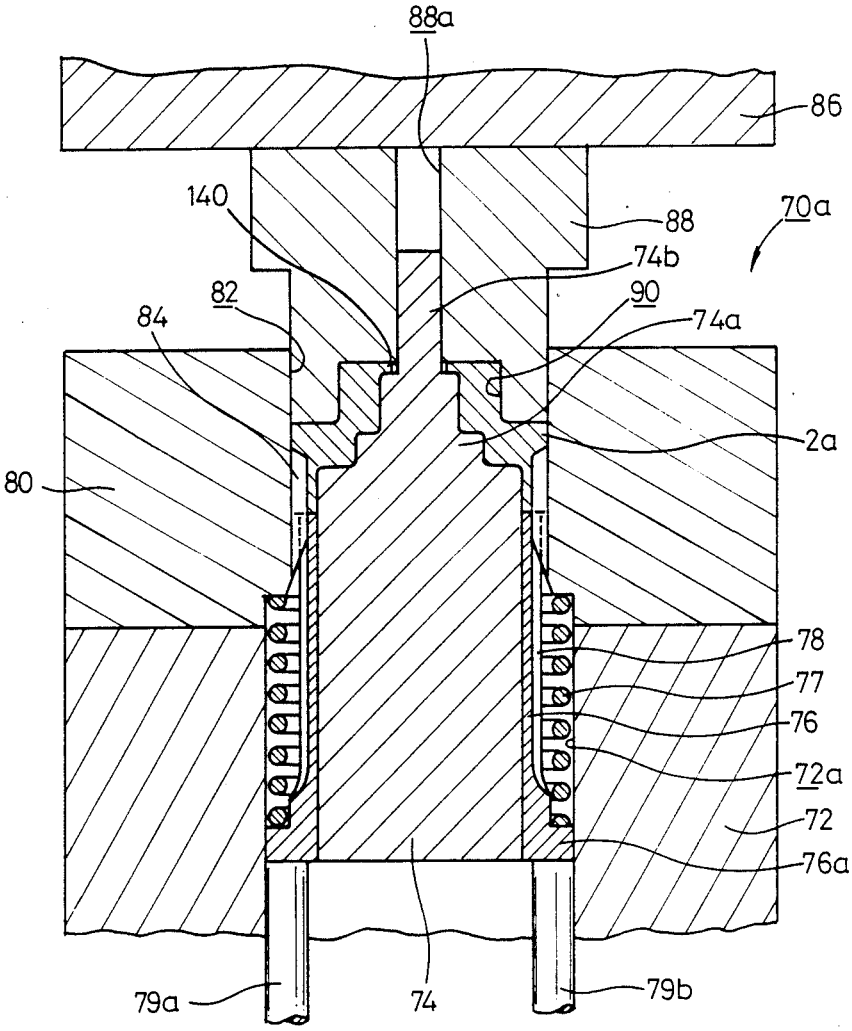
FIG. 16 is a fragmentary vertical perspective view of an extrusion die assembly according to another embodiment of the present invention.

FIG. 16 shows an extrusion die assembly according to another embodiment of the present invention. Those components shown in FIG. 16 which are identical to those of the previous embodiment are denoted by identical reference numerals, and will not be described in detail.

An extrusion die assembly 70a shown in FIG. 16 includes a guide rod 74b disposed coaxially on the tip end of the stepped portion 74a of the punch 74, the guide rod 74b being of a relatively small diameter and having a prescribed projecting length. The die 88 has a guide hole 88a defined coaxially therein in communication with the cavity 90.

When the workpiece $W_1$ is extruded, the guide rod 74b of the punch 74 is fitted into the guide hole 88a of the die 88. Therefore, the punch 74 can accurately be positioned and guided with respect to the die 88, so that the intermediate blank 2a produced is of better dimensional accuracy. The guide rod 74b is also advantageous in that it can limit the inside diameter of an extension 140 formed in the gap between the bottom surface of the cavity 90 and the tip end of the stopped portion 74a.

Figure 17:
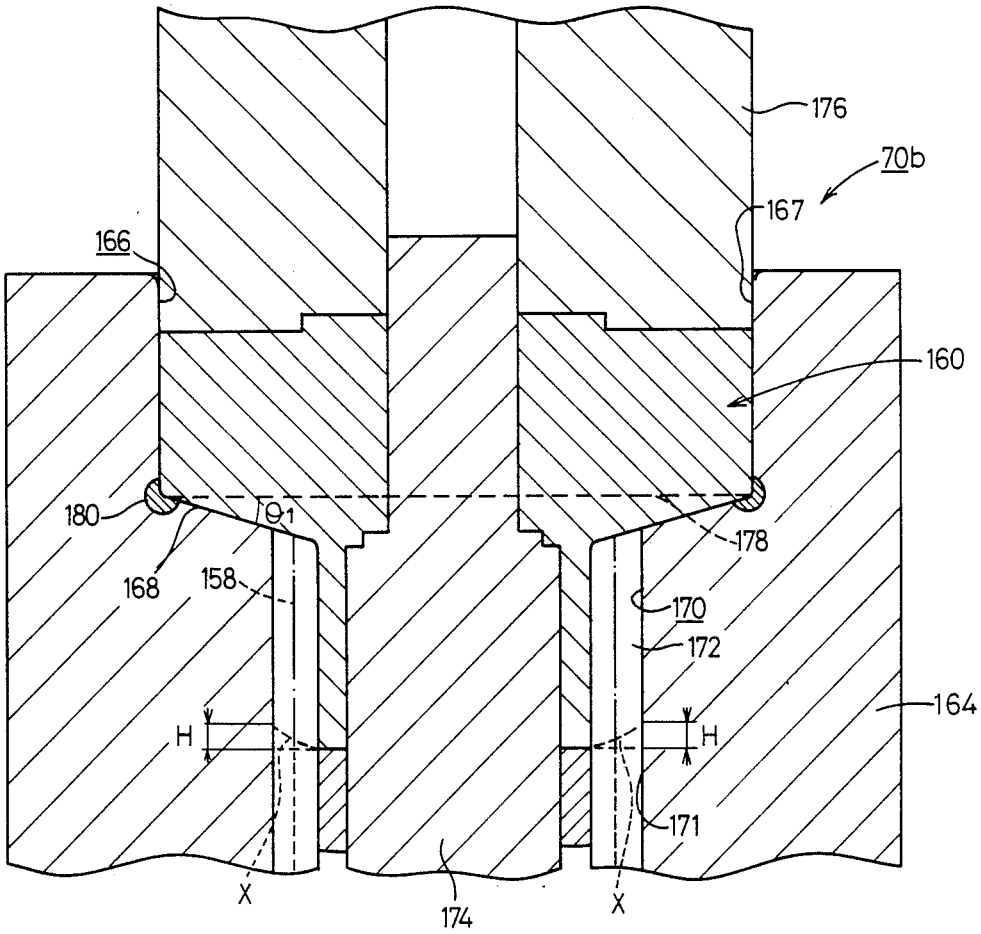
FIG. 17 is a fragmentary vertical perspective view of an extrusion die assembly according to still another embodiment of the present invention.

An extrusion die assembly 70b according to still another embodiment is illustrated in FIG. 17. The extrusion die assembly 70b is constructed to form an intermediate blank 160 having rough teeth 158 on its smaller-diameter portion. The extrusion die assembly 70b includes a teeth forming member 164 having a hole 166 defined therein for accommodating a larger-diameter portion of the intermediate blank 160. The hole 166 is defined by a first inner peripheral surface 167 which is joined via a squeezing region 168 to a second inner peripheral surface 171 which defines a hole 170 having a smaller diameter than the diameter of the hole 166 in the teeth forming member 164. The second inner peripheral surface 171 has a plurality of circumferentially spaced, axially extending protuberances 172. The extrusion die assembly 70b also includes a punch 174 disposed in the hole 170, and a die 176 supported on an upper support (not shown), the die 176 being vertically movable toward and away from the teeth forming member 164.

The squeezing region 168 is downwardly slanted axially inwardly at an angle $\theta_1$ of depression with respect to a plane 178 passing through the lower end of the first inner peripheral surface 167. A region 180 near the point of intersection between the lower end of the first inner peripheral surface 167 and the upper end of the squeezing region 168 is not ionitrided for case-hardening purpose The other region of the inner peripheral surface of the teeth forming member or die 164 than the region 180 is case-hardened by ionitriding.

Figure 18:
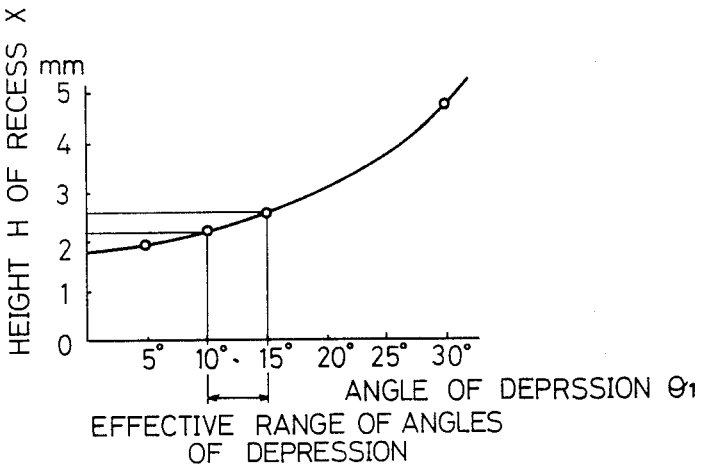
FIG. 18 is a graph illustrating the relationship between the angle of depression of a squeezing region of the die assembly shown in FIG. 17 and the height of an allowable recess.

An experiment was conducted when extruding the intermediate blank 160 in the extrusion die assembly 70b to determine the relationship between the angle $\theta_1$ of depression of the squeezing region 168 with respect to the plane 178 at the lower end of the first inner peripheral surface 167 and the height H of a recess X developed at the lower ends of formed rough teeth 162. The results of the experiment shown in FIG. 18 indicate that the range of angles $\theta_1$ of depression capable of keeping the height H in a prescribed range and of appropriately reducing the flow resistance during the extrusion of the blank was from 10° to 15°.

Figure 19:
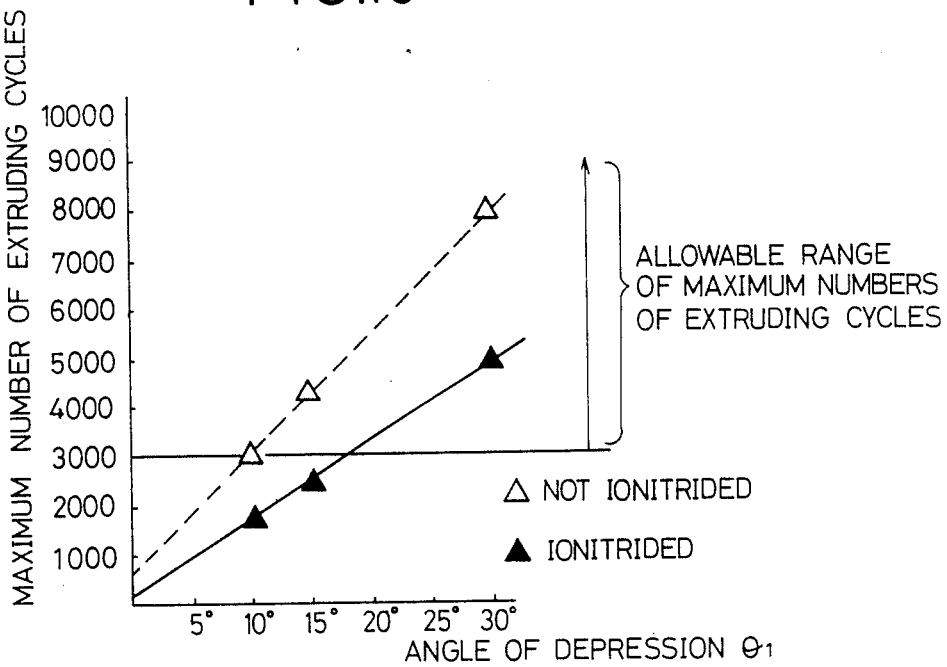
FIG. 19 is a graph showing the relationship between the angles of depression in the die assembly of FIG. 17 and a conventional die assembly and the maximum number of extruding cycles.

Another experiment was carried out on the extrusion die assembly 70b where the region 180 is not ionitrided and an extrusion die assembly where the corresponding region is ionitrided, while varying the angle $\theta_1$ of depression. The maximum numbers of extruding cycles that can be effected by these experimented extrusion die assemblies are shown in FIG. 19. It can been seen from FIG. 19 that if the preferable range of maximum numbers of extruding cycles is 3,000 or more with the angle $\theta_1$ of depression ranging from 10° to 15°, the extrusion die assembly with the region 180 not ionitrided met the preferable range, but the extrusion die assembly with the region 180 ionitrided fell short of the preferable range.

Figure 20:
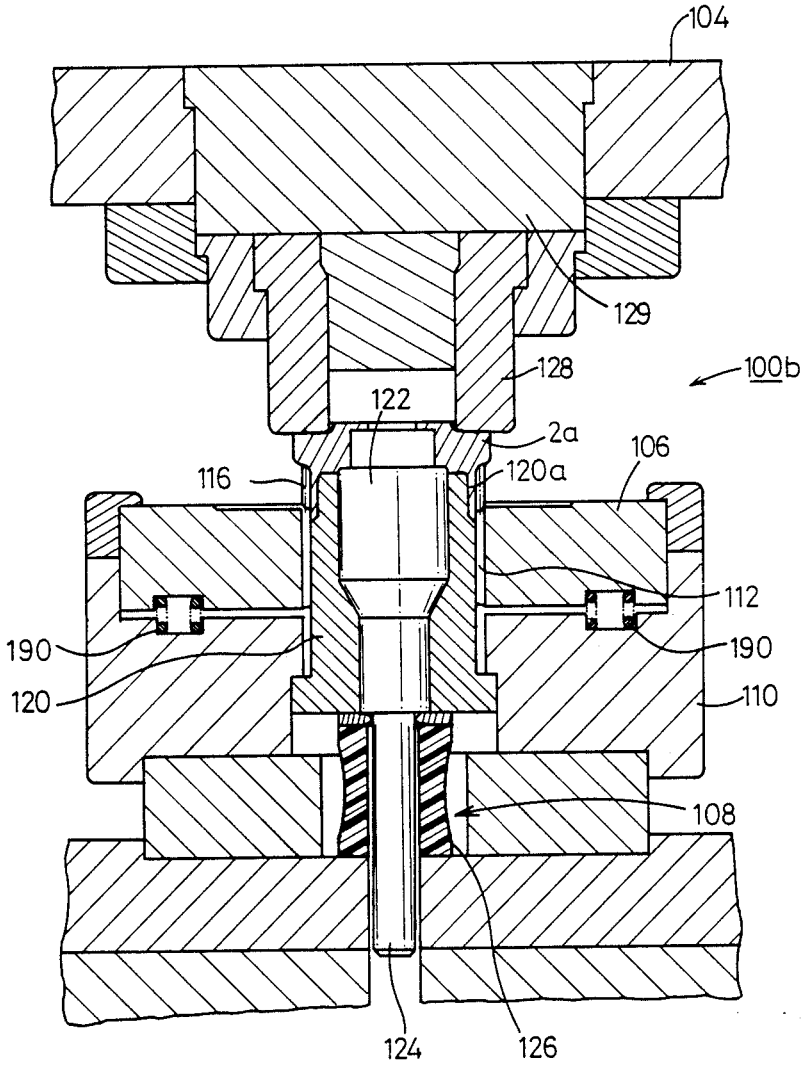
FIG. 20 is a fragmentary vertical cross-sectional view of a sizing device according to a further embodiment of the present invention.

FIG. 20 shows a sizing device 100a according to a further embodiment of the present invention. Those parts in FIG. 20 which are identical to those of the sizing device 100 shown in FIGS. 8 and 9 are designated by identical reference numerals, and will not be described in detail.

The sizing device 100a includes compression springs 190 disposed between the die 106 and the die holder 110 at equally circumferentially spaced positions. The die 106 is normally urged vertically upwardly under the resiliency of the compression springs 190. The die 106 is annularly movable with respect to the die holder 110.

As described above with respect to FIGS. 8 and 9, the intermediate blank 2a is placed on the upper end 120a of the guide member 120 and the upper support 104 is lowered to enable the pusher punch 128 to press the intermediate blank 2a. The die 106 is resiliently supported axially in a floating manner by the compression springs 190, and is angularly movable with respect to the die holder 110, as described above. Therefore, the finishing teeth 112 of the die 106 are automatically shifted into phase or meshing alignment with the rough teeth of the intermediate blank 2a. The gear teeth which will be sized by the sizing device 100a are of a desired degree of accuracy, and the die 106 is prevented from damage.

Figure 21:
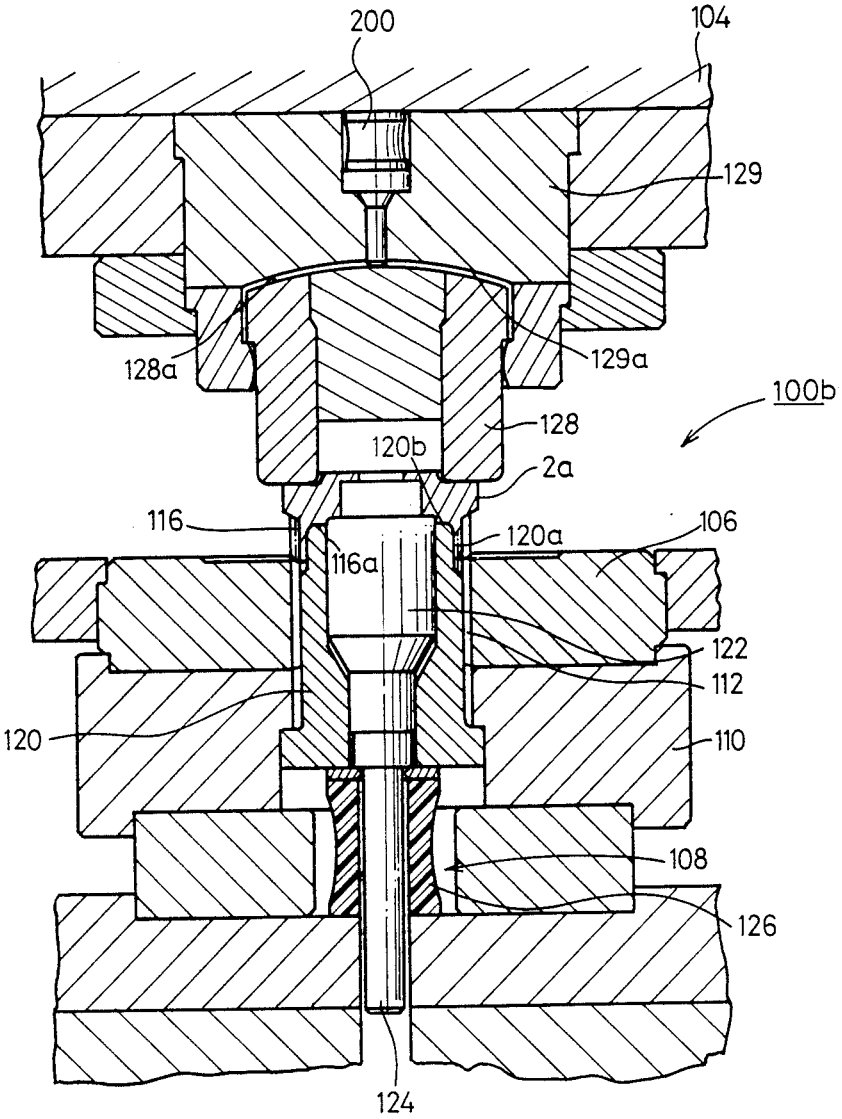
FIG. 21 is a fragmentary vertical cross-sectional view of a sizing device according to a still further embodiment of the present invention.

A sizing device 100b according to a still further embodiment of the present invention is illustrated in FIG. 21. Those parts in FIG. 21 which are identical to those of the sizing device 100 shown in FIGS. 8 and 9 are designated by identical reference numerals, and will not be described in detail.

In the sizing device 100b, the punch holder 129 has a partly spherical curved surface 129a defined in the lower end thereof, and a cushioning member 120 made of urethane resin or the like is held in the punch holder 129 and has its lower tip end projecting out of the curved surface 129a. The pusher punch 128 has a partly spherical curved surface 128a defined in the upper surface thereof in complementary relation to the curved surface 129a, with a prescribed gap or clearance being left between the curves surfaces 129a, 128a.

In operation, the intermediate blank 2a is placed on the upper end 120a of the guide member 120, and the upper support 104 is lowered to displace the pusher punch 128 into abutment against the intermediate blank 2a. As described above, the pusher punch 128 is resiliently supported in a floating fashion on the punch holder 129 by the cushioning member 200, and the punch holder 129 and the pusher punch 128 have the respective partly spherical curved surfaces 129a, 128a fitted complimentarily to each other. Therefore, the pusher punch 128 can tilt its axis according to the configuration of the upper surface of the intermediate blank 2a until the pusher punch 128 is neatly and reliably held in close contact with the upper surface of the intermediate blank 2a. Further downward movement of the pusher punch 128 caused by the upper support 104 brings the curves surfaces 129a, 128a into intimate contact with each other, and presses the intermediate blank 2a into the die 106 while the intermediate blank 2a is being sandwiched between the pusher punch 128 and the guide member 120.

The arrangement of FIG. 21 is effective to maintain the axis of sliding movement of the intermediate blank 2a accurately for thereby preventing a reduction in the accuracy of the cylindrical shape defined by the top lands of the gear teeth, which would otherwise be caused by irregular pressing forces from the pusher punch 128. That is, even if the perpendicularity of the surface of the intermediate blank 2a abutting against the pusher punch 128 with respect to the axis of the gear teeth is varied from blank to blank, it is possible to form accurate gear teeth 8 on the intermediate blank 2a.

With the present invention, as described above, for manufacturing a gear of a small thickness and a complex shape, a workpiece is upset and pierced by warm forging and thereafter extruded to form gear teeth by warm extrusion, and then the extruded gear teeth are finished to high accuracy by cold sizing. Therefore, it is not necessary to normalize the gear and descale the gear by shot blasting. The gear can be forged in a small number of processes with high accuracy, without the gear teeth being machined. Since the gear can be produced with relative high precision, any amount of metal to be subsequently cut off the gear is reduced, and the yield the of gears is high.

In the upset-forging, inasmuch as a recess of a prescribed size is defined in a solid blank, any burr which may be produced in the piercing process can be held to a minimum. The blank has round corners to retain lubricating oil between the inner surfaces of dies and the blank during the piercing and teeth forming processes, so that the blank smoothly contacts the inner surfaces of the dies, and any burr which may be formed in the clearance between the punch and the die in the teeth forming process is minimized. Thus, the gear of good appearance can be manufactured without damaging the die assemblies.

Moreover, metal of the blank is pushed or caused to flow to prevent any recess from being formed in the teeth when extruding the teeth. It is also possible to keep the end of the boss of the gear to proper dimensional precision, and the load imposed on the die assembly is reduced. At the same time, an extension which will serve as a member for engaging a shaft to which the gear is coupled can also be formed in the opening in the boss of the gear.

The extrusion die assembly for forming a stepped gear having a hollow space defined therein and including a smaller-diameter gear portion and a larger-diameter boss portion has the squeezing region corresponding in position to the boundary between the smaller-diameter gear portion and the larger-diameter boss portion, the squeezing region being slanted at an angle of depression ranging from 10° to 15° with respect to a diametrical plane of the die The squeezing region can reduce resistance to the flow of metal of the blank over the squeezing region into the teeth forming region when the blank is extruded, so that it becomes possible to extrude a gear having a smaller recess in the teeth and an increased effective tooth length. An inner surface region of the die near the squeezing region is not case-hardened and is hence prevented from being cracked during the extrusion process. The other inner surface region of the die, other than the region which is not case-hardened, is case-hardened to reduce wear due to frictional contact with the blank as it is extruded. Therefore, the extrusion die assembly is highly durable.

In addition, it is possible according to the present invention to prevent the intermediate blank from being displaced off center or falling over with respect to the die and the punch when the intermediate blank is sized. Where the intermediate blank has an inner hole, the inner hole is restrained by the guide member to prevent the intermediate blank from being distorted, and a highly accurate gear of stable quality can be manufactured. The arrangement of the invention is highly effective to increase productivity and greatly reduce the proportion of defective gears.

Gears which have remaining metal which is left in an axial end after extrusion and hence do not have a through hole can be formed with increased tooth shape accuracy and tool surface accuracy. Desired accuracy can be achieved without requiring secondary machining on formed gears. Thus, the present invention is effective in reducing the entire number of processes. Even if metal is localized in the left metal portion of the intermediate blank, such localized metal can be absorbed by the tapered edge of the gear teeth, and the extrusion die assembly is increased in durability.

Although certain preferred embodiments have been shown and described, it should be understood that many changes and modifications may be made therein without departing from the scope of the appended claims.

What is claimed is:

1. A method of manufacturing a gear, comprising the steps of:

upsetting a blank;

piercing said blank heated up to a warm forging temperature range;

forming gear teeth on said blank by warm extrusion; and sizing said gear teeth by cold sizing.

2. A method according to claim 1, wherein said blank is upset and pierced by forming a projection on one end of said blank, defining first and second recesses in the other end of said blank and said projection, and defining a through hole through said first and second recesses.

3. A method according to claim 1 or 2, wherein said blank is upset and pierced to form a hollow blank having an inner hollow space therein and larger- and smaller-diameter portions, and said gear teeth are formed to produce a larger-diameter tooth portion and a smaller-diameter boss portion on the blank.

4. A method of manufacturing a gear, comprising the steps of:

piercing a blank to produce a hollow blank with a punch and a die; and extruding said hollow blank to form gear teeth on the hollow blank;

said blank having a recess defined in an end surface thereof remote from said punch, said recess having a minimum diameter portion and an outer maximum diameter larger than the outside diameter of said punch and being progressively smaller in diameter toward said punch, said blank having a round corner for slidably contacting dies used to pierce said blank and extrude said hollow blank, said blank being pierced by defining a hole therein coaxially with said minimum diameter portion of said recess, said hole being slightly larger in diameter than said minimum diameter portion of the recess.

5. A method according to claim 4, wherein said recess is defined by a surrounding slanted surface inclined at an angle ranging from 30° to 45° to a plane transverse to the axis of said blank.

6. A method of manufacturing a stepped gear having a hollow space therein and a larger-diameter tooth portion and a smaller-diameter boss portion, said method comprising the steps of: preparing a blank having a smaller-diameter blank portion shorter than the height of the smaller-diameter boss portion, a larger diameter blank portion integral with said smaller-diameter blank portion, a hollow blank portion extending through said blank portions; and defining a hollow portion in said blank with first and second forming members coacting with each other, said hollow portion including a smaller-diameter portion near said first forming member and a larger-diameter portion near said second forming member, by extruding a material of said larger-diameter blank portion toward said second forming member and pressing said material into a teeth forming region around said second forming member for thereby forming gear teeth, extruding a material of said smaller-diameter blank portion toward said first forming member for thereby forming a boss portion, bringing a material of said smaller-diameter portion into abutment against an end surface of said first forming member, and pressing said smaller-diameter portion material into a gap defined between said end surface and an end surface of said second forming member, substantially upon completion of the extrusion process.

7. A method of shaping a solid blank for use in manufacturing a stepped gear having a larger-diameter portion and a smaller-diameter portion, said method comprising the steps of: placing a blank between a first die member and a second die member coating with said first die member, said first die member having a first forming member including an outer peripheral stepped portion having a projecting end surface and a second forming member having an inner peripheral surface in which said first forming member is fitted and an annular end surface; causing a material of said blank to flow in a direction toward said stepped portion of the first forming member and in a radial direction along said annular end surface of the second forming member under a pressure applied by said first forming member while the blank is being resiliently supported by said second forming member through a resilient member, in response to coaction of said first and second die members; and then bringing said second forming member into engagement with said first forming member to cause said first and second forming members to jointly apply a pressure to said blank to into the solid blank having the larger- and smaller-diameter portions.

8. A method of manufacturing a gear, comprising the steps of: preparing an intermediate blank having rough gear teeth on an outer peripheral surface along an axis thereof and a remainder material left on one end thereof, through an extrusion process; and pressing said intermediate blank into a die having finishing teeth to size the intermediate blank by defining a first gap between said remainder material and a tapered surface on an entrance end of said finishing teeth substantially fully around the finishing teeth, defining a second gap at bottom lands between said intermediate blank and said die, and forcibly pushing an excessive material produced by sizing the intermediate blank into said first and second gaps.

9. A method of manufacturing a gear by sizing a roughly extruded intermediate blank with a die and a punch, said method comprising the steps of: bringing one end of said intermediate blank into engagement with guide means for controlling a direction in which to displace said intermediate bank; imposing a corrective load to hold an end of said punch and the other end of said intermediate blank in intimate contact with each other; and pressing said intermediate blank into said die through said guide to size the intermediate blank.

10. A method according to claim 9, wherein a resilient member is held in engagement with said guide means, and said die and said punch are displaced toward each other while said one end of the intermediate blank is engaging said guide means, so that the resiliency of said resilient member acts as said corrective load to hold said end of the punch and said other end of the intermediate blank in intimate contact with each other.

11. An apparatus for manufacturing a stepped gear having a hollow space therein and a larger-diameter tooth portion and a smaller-diameter boss portion, said apparatus comprising: first and second forming members for extruding a blank having a smaller-diameter blank portion shorter than the height of the smaller-diameter boss portion, a larger-diameter blank portion integral with said smaller-diameter blank portion, and a hollow blank portion extending through said blank portions; and a teeth forming member disposed around said second forming member, said first forming member having a recess for forming said boss portion, said second forming member having a smaller-diameter projection portion projecting toward said recess and having a diameter smaller than the inside diameter of said recess, and a larger-diameter portion coaxial with said smaller-diameter projecting portion and extending away from said first forming member, said larger-diameter portion having a maximum diameter selected to be larger than the inside diameter of said recess of said first forming member wherein a gap is defined between the bottom surface of said recess of the first forming member and the tip end of said smaller-diameter projection portion of said second forming member substantially upon completion of extrusion of said blank.

12. An apparatus according to claim 11, further comprising a die disposed around said second forming member and having a hole defined by an inner peripheral wall surface having a teeth forming region composed of a plurality of axially extending protuberances, said second forming member being axially movably disposed in said hole of said die.

13. An apparatus according to claim 11, wherein said first forming member has a guide hole defined in said recess, and said smaller-diameter projecting portion of said second forming member has a guide rod slidably fitted in said guide hole for guiding relative movement of said first and second forming members.

14. An apparatus for manufacturing a stepped gear having a hollow space therein and a larger-diameter tooth portion and a smaller-diameter boss portion, said apparatus comprising a first inner peripheral surface defining a first hole; a second inner peripheral surface defining a second hole substantially coaxial with said first hole and having a plurality of teeth forming protuberances extending axially of said second hole; and a squeezing region joining an end of said first inner peripheral surface and an end of said second inner peripheral surface, said squeezing region having an angle of depression ranging from 10° to 15° with respect to a plane passing through said end of said second inner peripheral surface, said end of said first inner peripheral surface and said squeezing region intersecting with each other near a region which is not case-hardened, said first inner peripheral surface, said second inner peripheral surface, and said squeezing region being case-hardened except for said region which is not case-hardened.

15. An apparatus for manufacturing a gear by pressing an intermediate blank having rough gear teeth on an outer peripheral surface along an axis thereof and a remainder material left on one end thereof, prepared through an extrusion process, into a die having finishing teeth to size the intermediate blank, said apparatus comprising a tapered surface on an entrance end of said finishing teeth substantially fully around the finishing teeth, said rough teeth of the intermediate blank having an addendum circle and a deddendum circle, said finishing teeth having a shape wherein a diameter of a circle corresponding to said addendum circle of the rough teeth is larger than a diameter of a corresponding circle of the finishing teeth and a diameter of the deddendum circle of the rough teeth is smaller than the diameter of a corresponding circle of the finishing teeth, the rough teeth having a tooth surface which can progressively be squeezed less from bottom lands toward lands thereof.

16. An apparatus according to claim 15, further comprising a resilient member interposed between said die and said die holder for resiliently supporting said die in a floating manner on said die holder.

17. An apparatus for manufacturing a gear by sizing a roughly extruded intermediate gear, comprising: a pump and a die which are movable toward and away from each other along a common axis, said die being supported in a floating manner so as to be displaceable axially and circumferentially; and guide means resiliently supported on said die and displaceable axially toward said punch for controlling a direction in which said intermediate blank can be displaced.

18. An apparatus for manufacturing a gear by sizing a roughly extruded intermediate gear, comprising: a pump and a die which are movable toward and away from each other along a common axis, said punch having automatic centering means for tilting an axis of said punch, said punch being resiliently supported axially displaceably in confronting relation to said die; and guide means resiliently supported on said die and displaceable axially toward said punch for controlling a direction in which said intermediate blank can be displaced.

19. An apparatus according to claim 18, wherein said automatic centering mean comprises a first partly spherical surface defined in said punch holder and curved inwardly, and a second partly spherical surface defined in said punch and curved outwardly in complementary relation to said first partly spherical surface.

20. An apparatus according to claim 19, further comprising a resilient member mounted on said punch holder and having an end projecting out of said first partly spherical surface and engaging said second partly spherical surface for resiliently supporting said punch on said punch holder.

* * * * *